US006960130B2

(12) United States Patent
Gebke et al.

(10) Patent No.: US 6,960,130 B2
(45) Date of Patent: Nov. 1, 2005

(54) FABRIC AIR DUCT WITH DIRECTIONAL VENT

(75) Inventors: Kevin J. Gebke, Dubuque, IA (US); Robert J. Harter, LaCrosse, WI (US); Matthew C. McNeill, White Fish Bay, WI (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 27 days.

(21) Appl. No.: 10/436,118

(22) Filed: May 12, 2003

(65) Prior Publication Data

US 2004/0229559 A1 Nov. 18, 2004

(51) Int. Cl.[7] ..... F24F 13/072
(52) U.S. Cl. ..... 454/306; 454/297
(58) Field of Search ..... 454/284, 292, 454/296, 297, 306

(56) References Cited

U.S. PATENT DOCUMENTS

| | | | | | |
|---|---|---|---|---|---|
| 4,425,839 | A | * | 1/1984 | Stull | 454/284 |
| 5,044,259 | A | * | 9/1991 | Catan et al. | 454/306 |
| 5,111,739 | A | * | 5/1992 | Hall | 454/306 |
| 5,655,963 | A | * | 8/1997 | Paschke et al. | 454/297 |
| 5,769,708 | A | * | 6/1998 | Paschke | 454/306 |
| 5,961,044 | A | | 10/1999 | Dalbec et al. | |
| 6,117,005 | A | * | 9/2000 | Weiss | 454/202 |
| 6,280,320 | B1 | * | 8/2001 | Paschke et al. | 454/298 |
| 6,425,417 | B1 | | 7/2002 | Paschke | |

FOREIGN PATENT DOCUMENTS

| | | | | |
|---|---|---|---|---|
| BE | 518391 | * | 2/1955 | 454/306 |
| EP | 0 899 519 | | 3/1999 | |
| FR | 499.715 | * | 2/1920 | 454/306 |

OTHER PUBLICATIONS

International Search Report from PCT/US04/14204 dated Oct. 22, 2004.
Written Opinion from PCT/US04/014204.

* cited by examiner

*Primary Examiner*—Harold Joyce
(74) *Attorney, Agent, or Firm*—Marshall, Gerstein & Borun LLP

(57) ABSTRACT

A fabric air duct of an HVAC system includes a discharge air register with an air deflector that extends along the length of the duct. Rotating or twisting the deflector adjusts the volume and/or direction of the air being discharged from the register. Even though the deflector is disposed inside the duct, the deflector can be twisted or rotated by manipulating the exterior fabric wall of the duct.

26 Claims, 8 Drawing Sheets

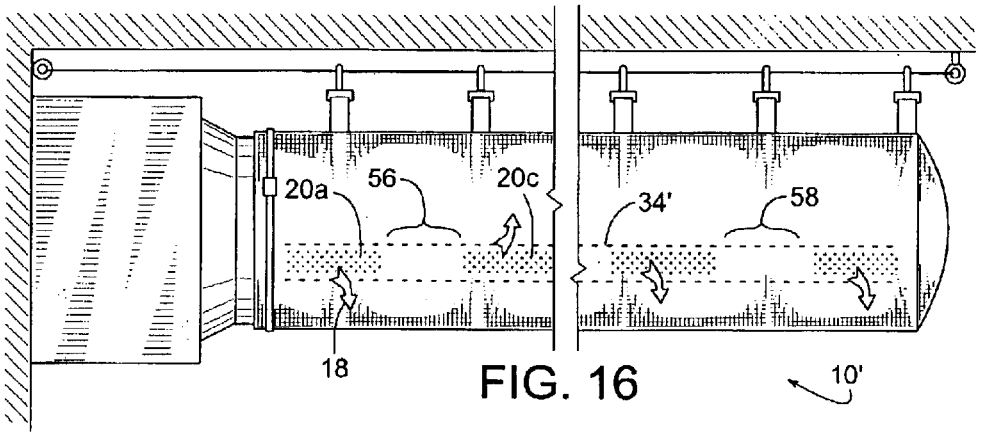
FIG. 16
FIG. 17
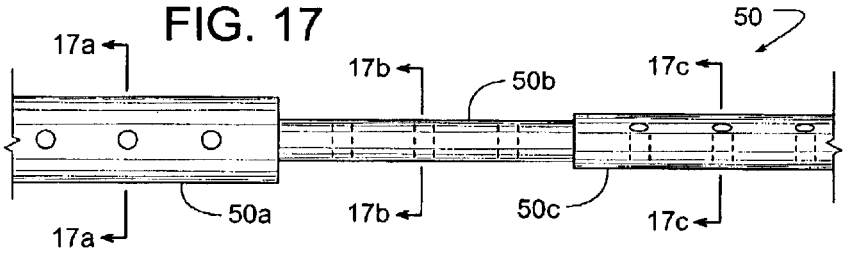
FIG. 17a
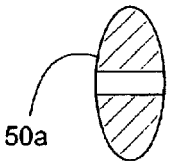
FIG. 17b
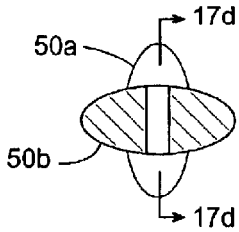
FIG. 17c
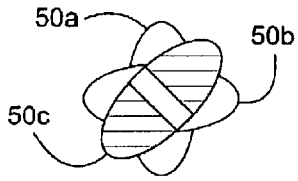
FIG. 17d
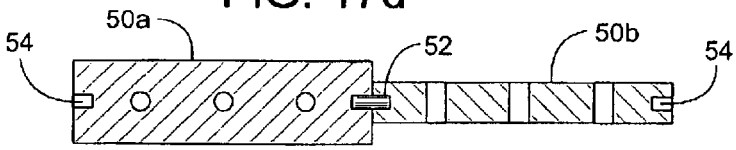

FABRIC AIR DUCT WITH DIRECTIONAL VENT

BACKGROUND OF THE INVENTION

1. Field of the Invention

The subject invention generally pertains to fabric air ducts and more specifically to a vent for such a duct.

2. Description of Related Art

HVAC systems (heating, ventilating and air conditioning systems) often include a network of sheet metal air ducts for conveying conditioned air through a building. The ductwork often includes several registers for discharging the air into certain rooms or areas within the building. To balance the distribution of airflow throughout the building, each register may include a damper for adjusting the amount or direction of airflow through individual registers. Currently, there is a wide assortment of registers and dampers that are readily available for use on ductwork made of sheet metal.

Sheet metal, however, is not necessarily the best material for air ducts. In many applications, such as food-processing facilities, the ducts are preferably made of a fabric or other type of pliable, non-corrosive material. Fabric and other pliable materials are often preferred when cleanliness, even air dispersion, condensation control, or appearance is a significant concern.

Unfortunately, conventional metal dampers and register are not readily incorporated into fabric ductwork. Metal hardware can be difficult to attach to fabric, the weight of the metal may pull and tear on fabric, and metal registers would most likely need to be removed before a fabric duct could be machined washed.

Some adjustable registers, nonetheless, have been designed specifically for use with fabric air ducts. An example of such a register is disclosed in U. S. Pat. No. 6,280,320. In this example, the register includes an elongate member that can be slid lengthwise to adjust the volume of air discharged from the duct. Although effective for its intended purpose, the volume of air through the register is substantially uniform over its entire length, and the register cannot adjust the direction of airflow.

To avoid creating an uncomfortable draft or to avoid discharging air directly against food products, in some cases it may be more desirable to redirect the airflow or to block off certain portions of it rather than to restrict the airflow along the entire length of the register. Thus, there is a need for providing fabric air ducts with a register that can change the volume and direction of airflow and perhaps do so at various locations along the length of the register.

SUMMARY OF THE INVENTION

In some embodiments, a fabric air duct includes an air deflector for adjusting the direction or volume of discharge air.

In some embodiments, an air deflector is mountable inside a fabric air duct and can be repositioned by manipulating the outer surface of the duct.

In some embodiments, a fabric air duct includes an elongate air deflector that can be twisted to change the airflow at varying degrees along the length of the deflector.

In some embodiments, a fabric air duct includes an elongate air deflector that has an oblong cross-sectional area.

In some embodiments, a fabric air duct includes a pliable air permeable strip of material for holding an air deflector inside the duct.

In some embodiments, the air permeable material is a fabric mesh that provides less airflow resistance than a plurality of holes in the fabric air duct.

In some embodiments, a fabric air duct includes an internal fabric sheath that allows an elongate air deflector to be readily removable from within the duct.

BRIEF DESCRIPTION OF THE DRAWINGS

FIG. 16 is similar to FIG. 1 but showing another embodiment of an air duct assembly.

FIG. 17 is a partial side view of a segmented air deflector.

FIG. 17*a* is a cross-sectional view taken along line 17*a*—17*a* of FIG. 17.

FIG. 17*b* is a cross-sectional view taken along line 17*b*—17*b* of FIG. 17.

FIG. 17*c* is a cross-sectional view taken along line 17*c*—17*c* of FIG. 17.

FIG. 17*d* is a cross-sectional view taken along line 17*d*—17*d* of FIG. 17*b*.

DESCRIPTION OF THE PREFERRED EMBODIMENT

Figure 1:
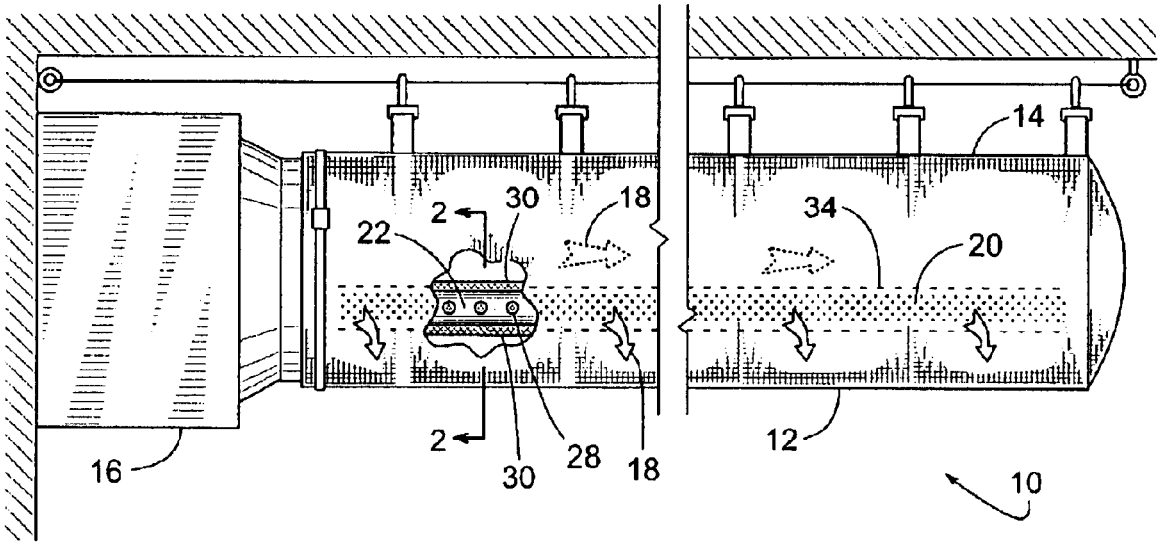
FIG. 1 is a side view of an air duct assembly with a cutaway view showing an air deflector.
Figure 2:
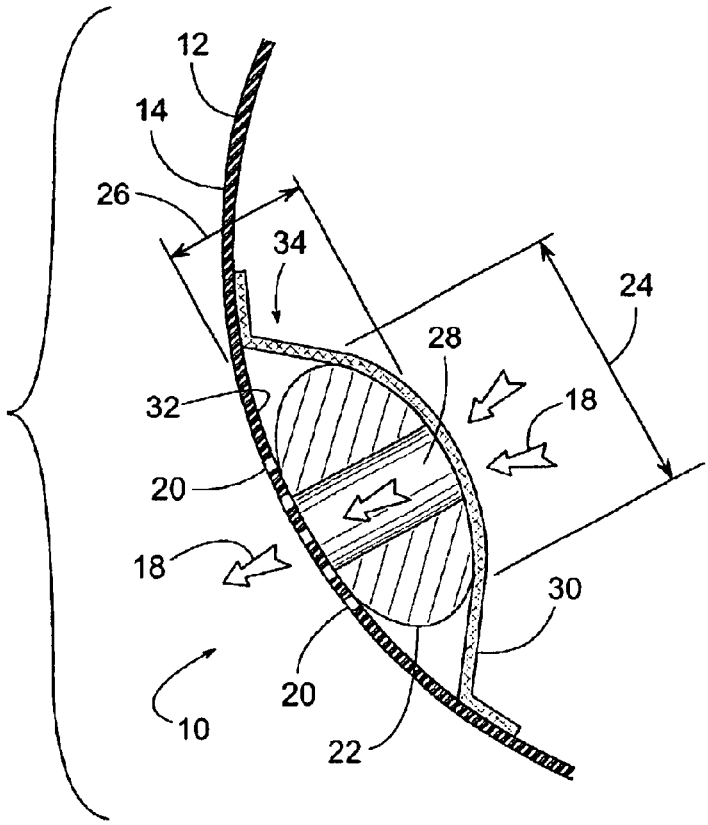
FIG. 2 is a cross-sectional view taken along line 2—2 of FIG. 1.

An air duct assembly 10, shown in FIGS. 1 and 2, comprises a tubular air duct 12 that has a pliable wall 14 made of fabric or some other type of pliable material. Duct 4 can be of any tubular cross-sectional shape including, but not limited to, round, semicircular, quarter-round, square, rectangular, triangular, etc. A source of pressurized air 16, such as a blower, forces air 18 into duct 12. To disperse the pressurized air into a room or other area of a building, the pliable wall 14 of duct 12 is air permeable in at least certain areas. The air permeability can be provided in various ways, including but not limited to making pliable wall 14 of a porous material or by perforating an otherwise impervious material.

For the illustrated example, the permeability of wall 14 is provided by a matrix of holes or openings 20. In some cases, the openings are about 0.188 inches in diameter and have a center-to-center spacing of about 0.625 inches. The openings may be evenly distributed over an area that is about two inches high and extending along a substantial length of duct 12. However, various other hole sizes and distribution patterns are well within the scope of the invention.

To allow adjustment of the volume and/or direction of the air discharging through openings 20, duct 12 includes a movable air deflector 22. Deflector 22 is preferably installed inside duct 12; however, it is also well within the scope of the invention to install deflector 12 on the exterior of the duct. In some cases, deflector 22 has an oblong cross-sectional area, as shown in FIG. 2, and may be of any length (e.g., one-foot, eight-feet, twenty-feet, or longer). In the example shown in FIG. 2, deflector 22 has a major thickness 24 and a minor thickness 26 with a plurality of holes 28 extending through the minor thickness 26. In some embodiments, major thickness 24 is 1.75 inches, minor thickness 26 is about one inch, and holes 28 have a diameter of about 0.5 inches with a center-to-center spacing of about 0.75 inches. Holes 28 serve as nozzles that direct pressurized air 18 through openings 20. FIGS. 1 and 2 show deflector 22 directing the airflow in a generally downward direction.

To hold deflector 22 in place, an air permeable pliable strip 30 (e.g., fabric netting, fabric screen, perforated plastic, etc.) holds deflector 22 up against an inner surface 32 of wall 14. Upper and lower edges of strip 30 can be sewn, bonded, or otherwise attached to inner surface 32 of wall 14. In effect, surface 32 and strip 30 provide a sheath 34 through which deflector 22 can be installed while still allowing periodic removal of the deflector so that wall 14 of duct 12 can be machine-washed.

Figure 3:
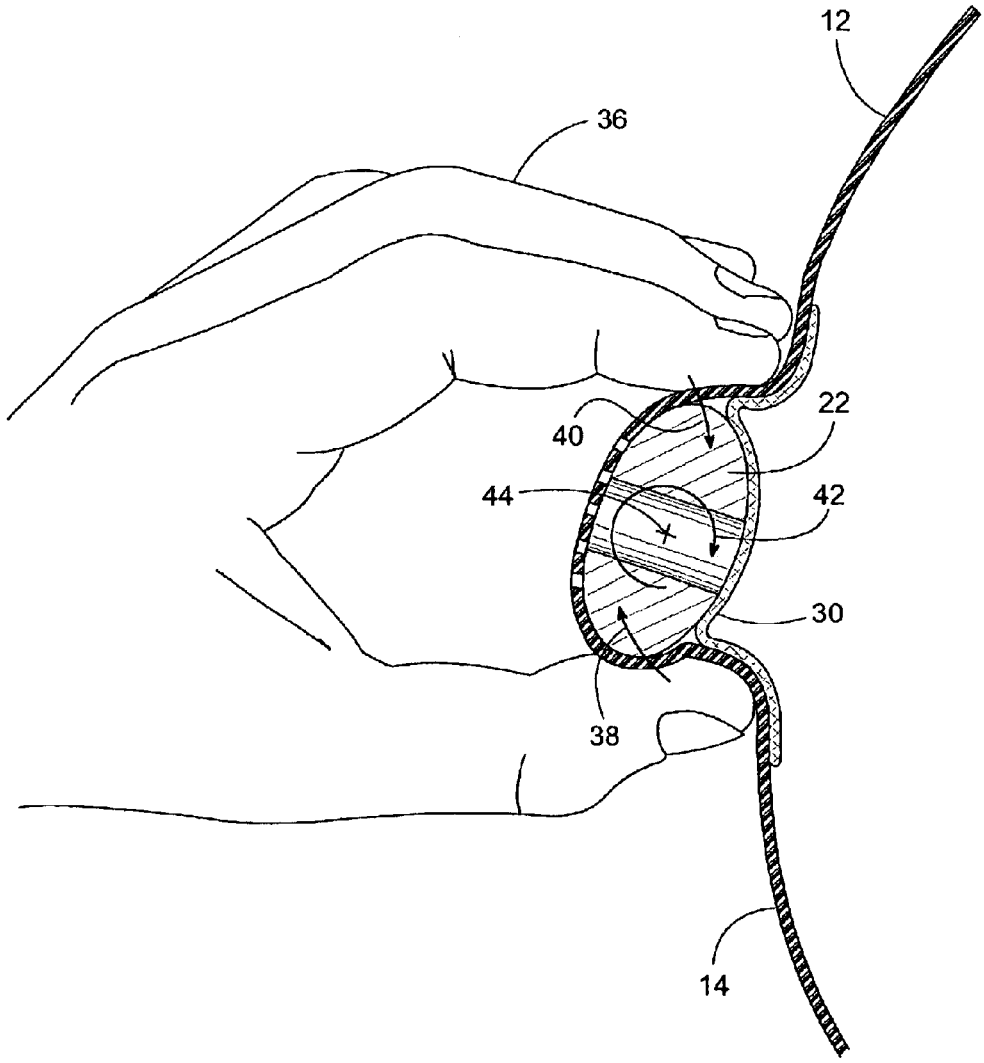
FIG. 3 is a cross-sectional end view showing the pliable wall of an air duct being manually manipulated to move an internally disposed air deflector.

To adjust the volume or direction of discharged air, the entire length of deflector 22 can be rotated or portions of its length can be twisted within sheath 34 by manually manipulating the exterior of wall 14, as shown by a hand 36 in FIG. 3. Arrows 38 and 40 represent manually exerted pressure that rotates or twists deflector 22 as indicated by arrow 42. To enable the twisting of just portions the deflector's length, deflector 22 may need to be sufficiently flexible about its longitudinal centerline 44. This can be achieved by various combinations of deflector shape, size, and material. In some embodiments, deflector 22 is made of PVC.

Figure 4:
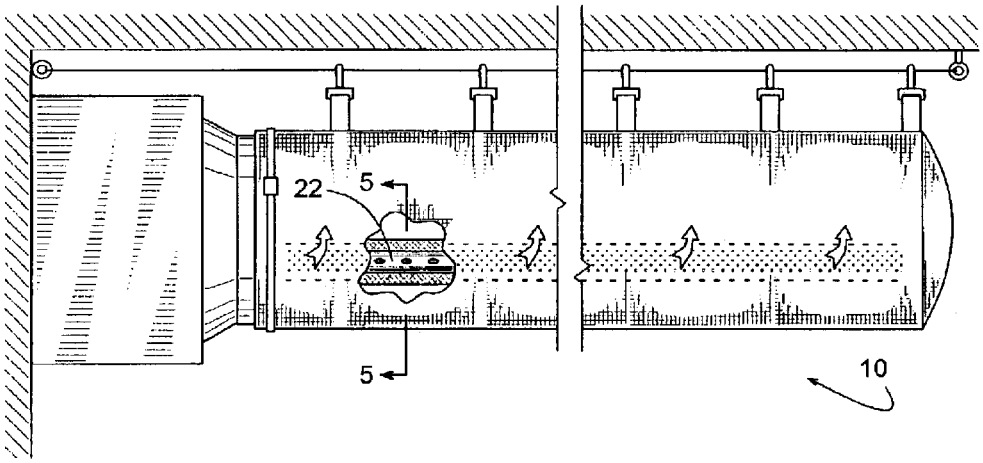
FIG. 4 is similar to FIG. 1 but showing the deflector in another position.
Figure 5:
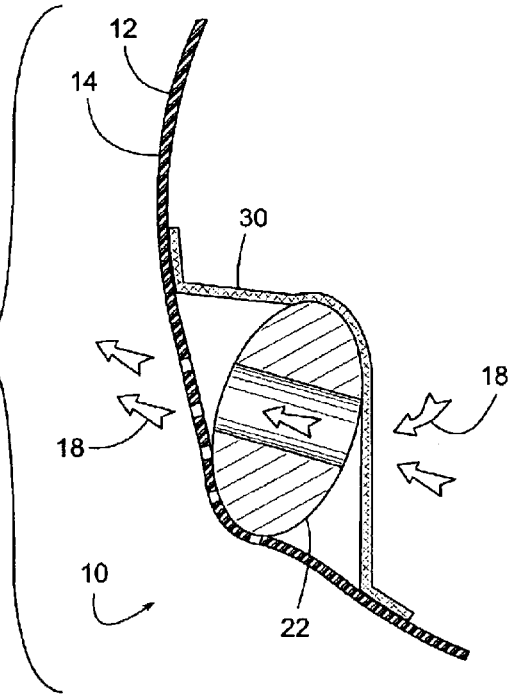
FIG. 5 is a cross-sectional view taken along line 5—5 of FIG. 4.

To direct the discharged air in a generally upward direction, deflector 22 can be rotated to the position shown in FIGS. 4 and 5.

Figure 6:
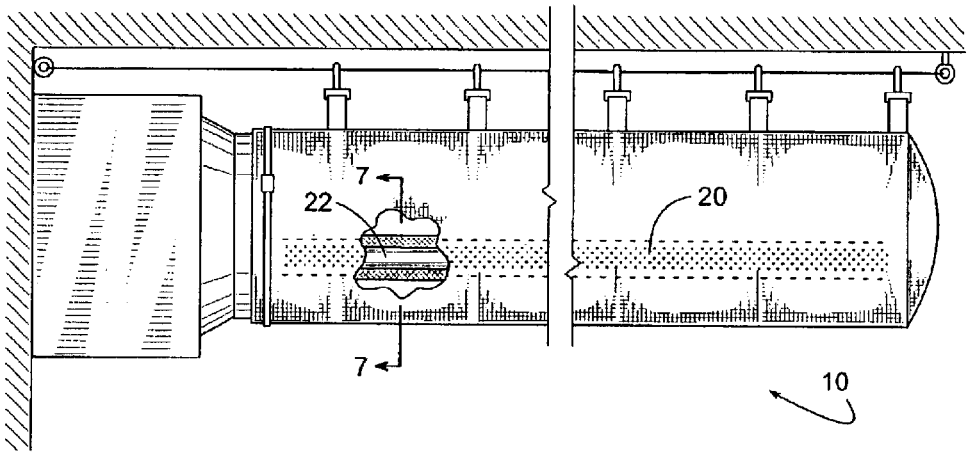
FIG. 6 is similar to FIG. 1 but showing the deflector in yet another position.
Figure 7:
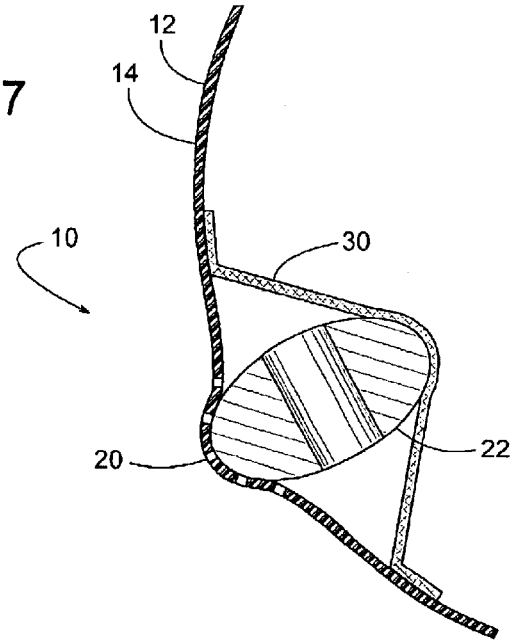
FIG. 7 is a cross-sectional view taken along 7—7 of FIG. 6.

To stop or minimize the airflow through openings 20, deflector 22 can be rotated to the position shown in FIGS. 6 and 7. In this position, deflector 22 is obstructs most or all of openings 20.

Figure 8:
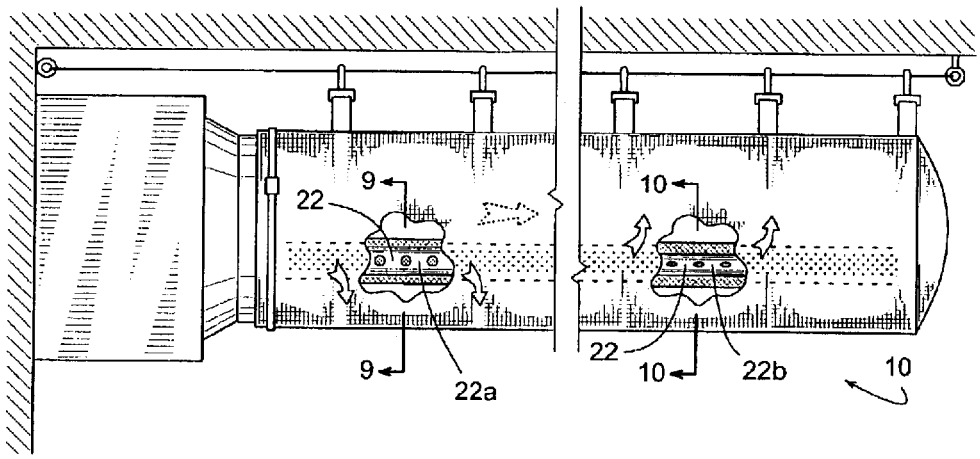
FIG. 8 is similar to FIG. I but with two cutaway views showing two portions of a twisted deflector.
Figure 9:
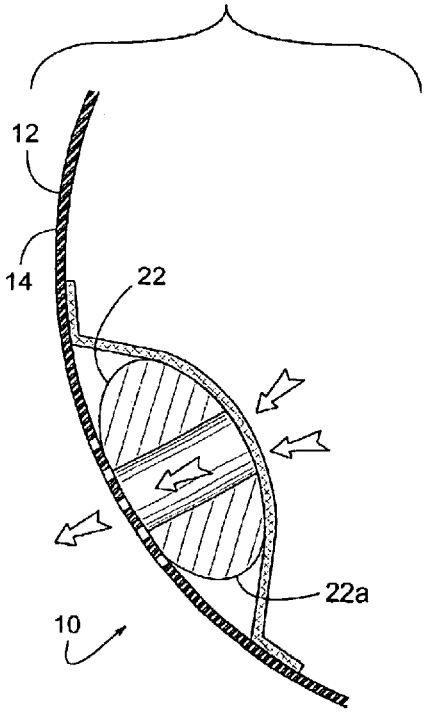
FIG. 9 is a cross-sectional view taken along line 9—9 of FIG. 8.
Figure 10:
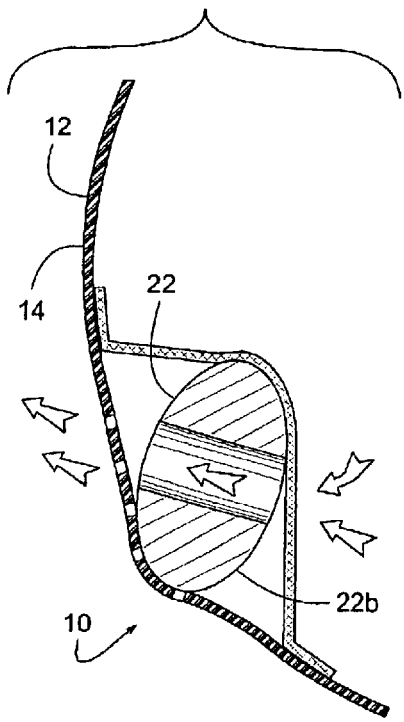
FIG. 10 is a cross-sectional view taken along line 10—10 of FIG. 8.

Referring to FIGS. 8, 9 and 10, deflector 22 can be twisted about itself to move a first portion 22*a* of deflector 22 to the position shown in FIG. 9 and to move a second portion 22*b* of deflector 22 to the position shown in FIG. 10. In this configuration, some of the discharge air is directed downward (FIG. 9) and some is directed upward (FIG. 10). Numerous other combinations include, but are not limited to, some areas with upward flow and other areas with no flow, some areas with horizontal flow and other areas with downward flow, some areas with horizontal flow and other areas with upward flow, etc. The number of discrete areas having their own particular direction or volume of flow is based on the deflector's length and rotational flexibility.

Figure 11:
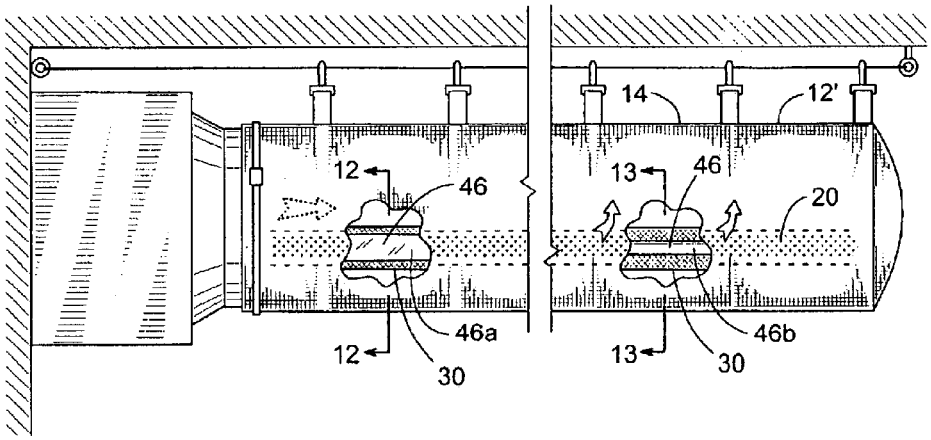
FIG. 11 is similar to FIG. 1 but with two cutaway views showing two portions of another twisted deflector.
Figure 12:
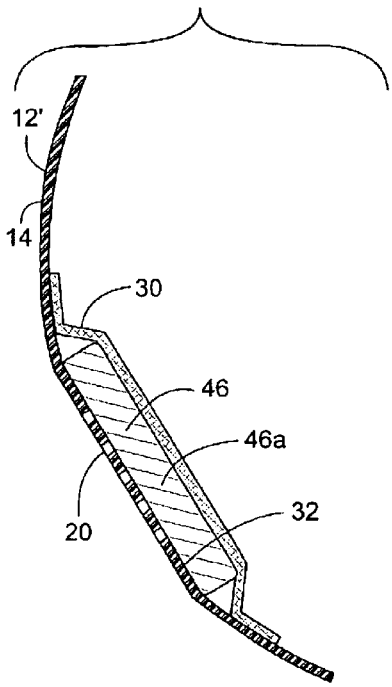
FIG. 12 is a cross-sectional view taken along line 12—12 of FIG. 11.
Figure 13:
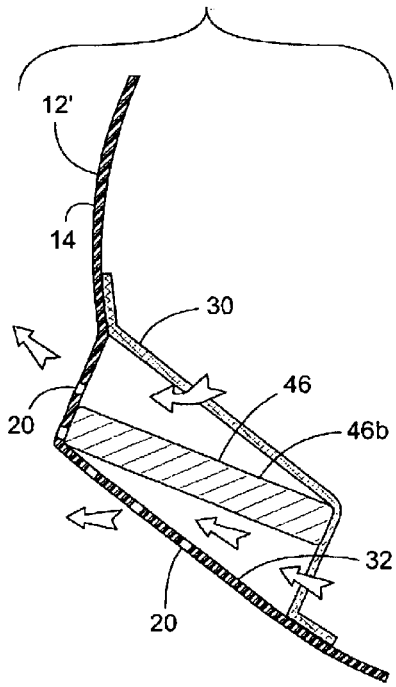
FIG. 13 is a cross-sectional view taken along line 13—13 of FIG. 11.

In another embodiment, shown in FIGS. 11, 12, and 13, a normally flat, thin deflector 46 is inserted between strip 30 and wall 14 of duct 12'. Deflector 46 can be twisted about itself with one portion 46a lying flat against surface 32 to block off flow through openings 20 and another portion 46*b* being positioned to direct the airflow in a generally horizontal or upward direction. Or the entire deflector can turned in the same direction to provide uniform airflow or no airflow across the entire length of the duct. Deflector 46 does not need any holes 28 since deflector 46 is sufficiently thin to allow air to pass by it when turned at an angle as shown in FIG. 13. Deflector 46 can be made of plastic, steel, or any other appropriate material.

Figure 14:
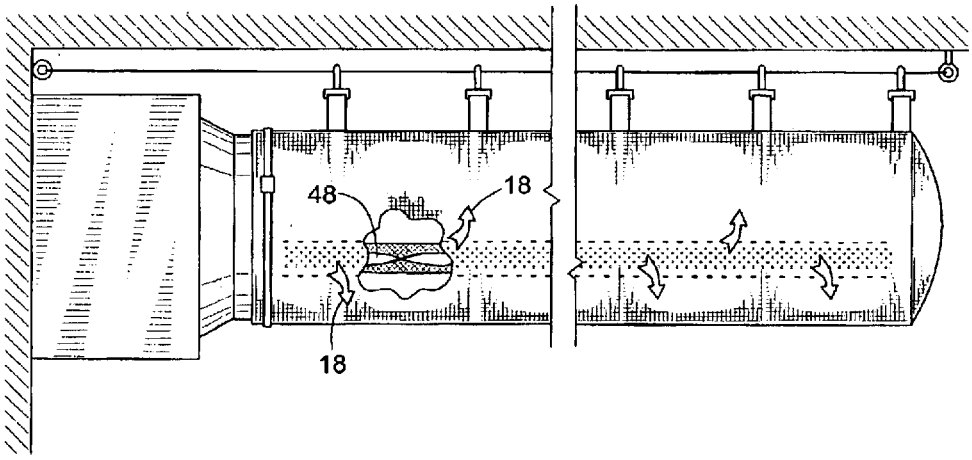
FIG. 14 is similar to FIG. 1 but with another type of air deflector installed inside the duct.
Figure 15:
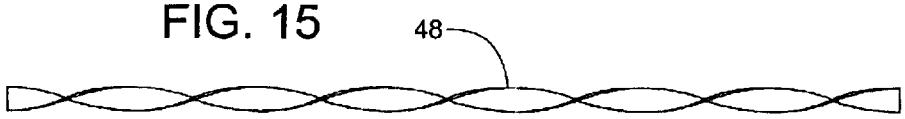
FIG. 15 is a side view of a helical air deflector.

In a similar embodiment, shown in FIGS. 14 and 15, a relatively thin deflector 48 has a permanent helical twist. When inserted within sheath 34 (FIG. 2), deflector 48 disperses the discharge air 18 in various directions: upward, downward, and horizontal. The direction of airflow at various areas along the length of the duct is determined by the rotational position of deflector 48 within sheath 34.

In another embodiment, shown in FIGS. 16 and 17, an air duct assembly 10' includes an air deflector 50 that is segmented, so individual segments (e.g., 50*a*, 50*b*, 50*c*, etc.) can be rotated independently of each other. This allows one segment to redirect the discharge airflow at certain areas along the length of duct assembly 10' while minimizing that segment's affect on other areas of the duct. Deflector 50 comprises at least two deflector segments (e.g., 50*a*, 50*b*, 50*c*, etc.) that can be installed end-to-end within a sheath 34'. Pins 52 inserted into axial cavities 54 can help align the series of segments, or the segments can simply abut one another without the use of pins 52. To minimize the number of pieces for a given deflector, pins 52 can be an integral extension of one end of each segment, so each segment would have a male and female end that allow the segments to be interconnected.

If it is desired to have some areas in a room provided with less air than others, an air duct assembly may have certain areas along its length that are void of openings 20. Air duct assembly 10', for example, has areas 56 and 58 where the airflow is completely blocked off. In this case, segment 50*a* may be adjacent to openings 20*a*, and segment 50*c* may be adjacent to openings 20*c*. Segments 50*a* and 50*c* can simply be spaced apart from each other with no segment by area 56 (i.e., omitting segment 50*b*), or segment 50*b* can be interposed between segments 50*a* and 50*c* as shown in FIG. 17. If segment 50*b* is used and is placed adjacent to area 56, then segment 50*b* would only serve as a spacer between segments 50*a* and 50*b*. Of to course, if openings 20*a* and 20*c* extended continuously without areas 56 and 58 as shown in FIG. 1, then all of the segments 50*a*, 50*b*, and 50*c* could be used to direct airflow.

Although the invention is described with reference to a preferred embodiment, it should be appreciated by those skilled in the art that various modifications are well within the scope of the invention. Therefore, the scope of the invention is to be determined by reference to the claims that follow.

We claim:

1. An air duct assembly, comprising:

an air duct having a pliable wall that defines a plurality of openings for discharging air therethrough; and an air deflector disposed within the air duct, urged up against the pliable wall, being adjacent to the plurality of openings, having a longitudinal centerline, and being rotatable about its longitudinal centerline to help determine in which direction the air passes through the plurality of openings.

2. The air duct assembly of claim 1, wherein the air deflector defines a plurality of holes for directing air therethrough.

3. The air duct assembly of claim 2, wherein the air deflector has a major thickness and a minor thickness that provides the air deflector with an oblong cross-sectional area.

4. The air duct assembly of claim 3, wherein the plurality of holes run through the minor thickness.

5. The air duct assembly of claim 1, further comprising a pliable strip attached to the pliable wall to define a sheath that contains the air deflector between the pliable strip and the pliable wall.

6. The air duct assembly of claim 5, wherein the pliable strip comprises a fabric mesh.

7. The air duct assembly of claim 5, wherein the pliable strip provides less airflow resistance than does the plurality of openings.

8. The air duct assembly of claim 1, wherein the air deflector is twistable about itself to vary, along a length of the air duct, the direction that the air passes through the plurality of openings.

9. The air duct assembly of claim 1, wherein the air deflector comprises a plurality of air defector segments that are disposed end-to-end.

10. The air duct assembly of claim 1, wherein the air deflector comprises a plurality of air defector segments that are spaced apart from each other.

11. An air duct assembly, comprising:

an air duct having a pliable wall that defines a plurality of openings for discharging air therethrough;

a pliable strip attached to the pliable wall and being air permeable; and an air deflector disposed between the pliable strip and the pliable wall, wherein the air deflector is movable for changing a direction that the air passes through the plurality of openings.

12. The air duct assembly of claim 11, wherein the air deflector defines a plurality of holes for directing air therethrough.

13. The air duct assembly of claim 12, wherein the air deflector has a major thickness and a minor thickness that provides the air deflector with an oblong cross-sectional area.

14. The air duct assembly of claim 12, wherein the plurality of holes run through the minor thickness.

15. The air duct assembly of claim 14, wherein the pliable strip comprises a fabric mesh.

16. The air duct assembly of claim 11, wherein the air deflector is twistable about itself to vary, along a length of the air duct, the direction that the air passes through the plurality of openings.

17. The air duct assembly of claim 11, wherein the air deflector comprises a plurality of air defector segments that are disposed end-to-end.

18. The air duct assembly of claim 11, wherein the air deflector comprises a plurality of air defector segments that are spaced apart from each other.

19. The air duct assembly of claim 11, wherein the pliable strip is disposed inside the air duct.

20. The air duct assembly of claim 11, wherein the air deflector is disposed inside the air duct.

21. A method of redirecting airflow through a pliable wall of an air duct that contains an air deflector, comprising: repositioning the air deflector by manipulating the pliable wall.

22. The method of claim 21, further comprising rotating the air deflector about a longitude centerline thereof.

23. The method of claim 21, further comprising twisting the air deflector about itself.

24. The method of claim 21, further comprising containing the air deflector between the pliable wall and a pliable strip that is attached to the pliable wall.

25. The method of claim 21, further comprising conveying air through a plurality of holes in the deflector.

26. The method of claim 21, further comprising pressing the air deflector up against an interior surface of the pliable wall.

* * * * *